US005573458A

United States Patent [19]

Chu

[11] Patent Number: 5,573,458

[45] Date of Patent: Nov. 12, 1996

[54] AIR-CONDITIONER OUTLET

[76] Inventor: Chia-Chuan Chu, 14F-3, No. 214, Fu-Hsing N. Road, Taipei, Taiwan

[21] Appl. No.: 611,959

[22] Filed: Mar. 6, 1996

[51] Int. Cl.[6] ..... F24F 13/075

[52] U.S. Cl. ..... 454/315; 454/202; 454/316

[58] Field of Search ..... 454/155, 202, 454/315, 316, 319, 321

[56] References Cited

U.S. PATENT DOCUMENTS

| | | | |
|---|---|---|---|
| 3,641,913 | 2/1972 | Dennis | 454/155 X |
| 3,735,691 | 5/1973 | Gofton et al. | 454/155 X |
| 4,345,510 | 8/1982 | Sterett | 454/155 X |
| 5,397,267 | 3/1995 | Vecellio et al. | 454/155 |

FOREIGN PATENT DOCUMENTS

| | | | |
|---|---|---|---|
| 61-128058 | 6/1986 | Japan | 454/155 |
| 4-148 | 1/1992 | Japan | 454/319 |
| 4-9543 | 1/1992 | Japan | 454/313 |

*Primary Examiner*—Harold Joyce
*Attorney, Agent, or Firm*—Albert C. Smith

[57] ABSTRACT

An air-conditioner outlet mounted into the holes predetermined on the wall comprises a seat with multiple wind outlets having a slot therein for slidably receiving a pushing button to adjust a plurality of movable leaves horizontally and elevationally. A link having a series of holes is connected with a plurality of movable leaves through the connection with the second lower protrusions provided at the other part of the lower end of the movable leaves with the holes of the link. Therefore, the pushing button is able to adjust the movable leaves by means of the connection between the second lower protrusions and the holes of the link.

5 Claims, 5 Drawing Sheets

AIR-CONDITIONER OUTLET

FIELD OF THE INVENTION

The present invention relates generally to an air-conditioner outlet and in particular to an outlet capable of controlling the wind blowing direction with a more efficient manner to increase the effect of air conditioning.

BACKGROUND OF THE INVENTION

Nowadays, it is necessary to install air-conditioning systems in the polluted environment, if acquiring fresh air is considered to be important. The air-condition system mainly filters out the polluted air by suction through the air inlet having an air-filter mounted therein, and the filtered fresh air is then out from an air outlet, sometimes, together with cold air due to the affect of a variety of cold agents. Referring to FIG. 5, which is the structure of a prior air conditioner outlet, wherein the outlet frame A of an outlet is generally composed integrally of side-frame and compartment plate A1. But the angle of an outlet of an outlet frame A of this type is so limited that only part of the people at a certain angle is able to have the benefit of the air conditioner. Moreover, the conjunction of the frame A of this type is not smooth enough. As can be seen from FIG. 6, the later known outlet frame B is made of other material (e.g. plastic steel) rather than the prior one, and the disadvantage of conjunction between frames still exists in this type of frame. The structure of this type of frame is that, on the front of the frame B, there vertically respectively mounted a number of movable front-leaves B1, and a plurality of movable back-leaves B2 are horizontally mounted thereon for adjusting respectively the moving angle of the front-leaves B1 and back-leaves B2 to reset the wind blowing direction according to the individual need. However, because the movable front-leaves B1 and back-leaves B2 are respectively, individually mounted thereon, it is quite troublesome, time consuming and a major disadvantage for the frame B to have a required wind blowing direction. It needs to adjust every movable leaves on the frame B. Besides, because the back-leaves B2 are mounted on the back of the front-leaves B1, and the aperture between every front-leave B1 is so limited that causes the adjusting of the back-leaves B2 and the disassembling of the frame B for cleaning very difficult.

SUMMARY OF THE INVENTION

It is therefore the main objective of the present invention to provide an air-conditioner outlet capable of controlling the moving angle of the back-leaves from the front side of the outlet constructed in accordance with the present invention and making the operation of resetting the left, right blowing direction easier.

Another objective of the present invention is to provide an outlet with smooth appearance.

Still another objective of the present invention is to provide an air-conditioner outlet available to disassemble easily for cleaning and other purposes.

The extended objective, advantages and features of the present invention will become apparent from the following description and the appended claims, taken in conjunction with the accompanying drawings.

BRIEF DESCRIPTION OF THE DRAWINGS

The present invention will be better understood from the following description of preferred embodiments of the present invention, with reference to the attached drawings, wherein.

DETAILED DESCRIPTION OF THE PREFERRED EMBODIMENTS

With reference to the drawings and in particular FIGS. 1–4, wherein an air-conditioner outlet is shown.

Figure 1:
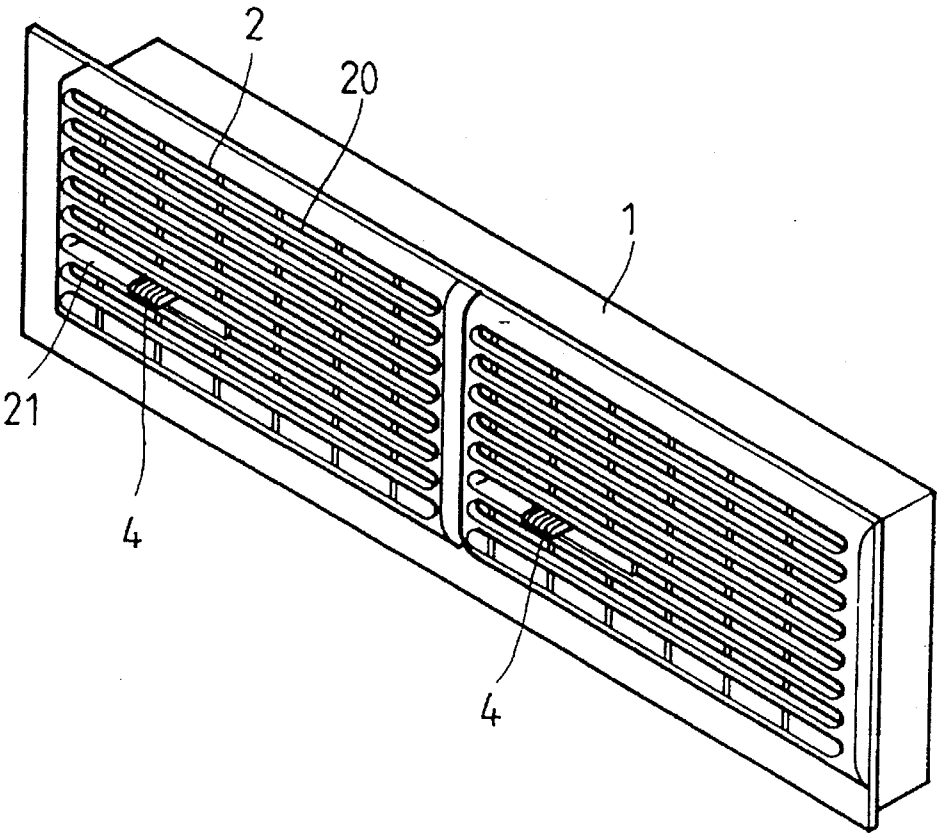
FIG. 1 is a perspective view of the present invention.
Figure 2:
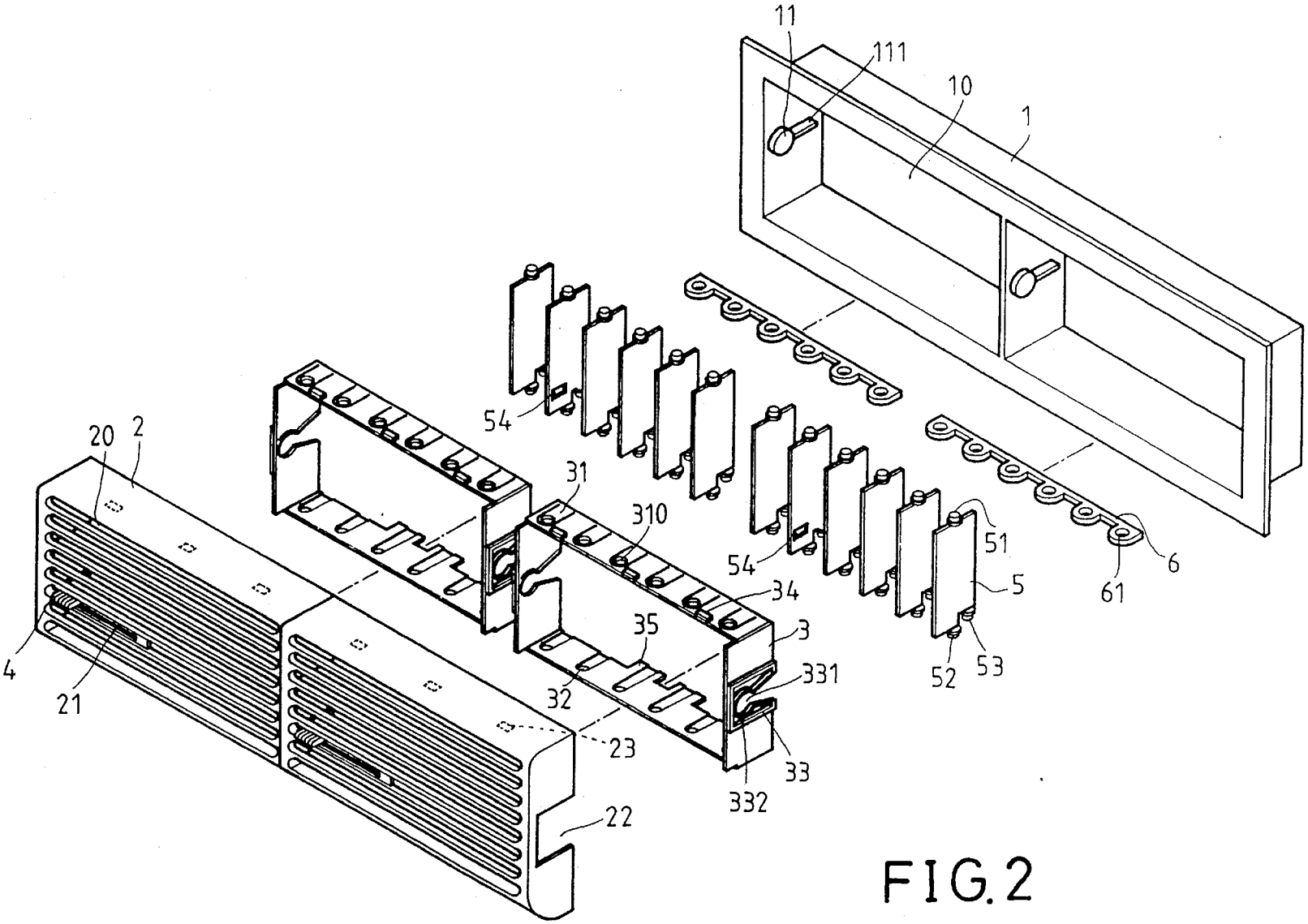
FIG. 2 is an exploded perspective view of the present invention.

Referring to FIGS. 1 and 2, wherein an outlet of the present invention comprises a seat 1 with a number of openings 10 therein for rigidly mounted into the predetermined hole on the wall, within the side walls of the openings 10, pivotal shafts 11 corresponding to each other in every openings 10 is provided in front of the horizontal blocking plate 111; a cover means 2 is so configured that the outer part is able to be inserted into the opening 10 of the seat 1 and the front part is provided horizontally with a plurality of plates forming wind outlet 20, a slot 21 is also provided at a suitable position in the wind outlet 20 for receiving a pushing button 4 which is freely slidable within the slot 21; the pushing button 4 further inwardly extends and forms an adjusting rod 41 having a groove 410 at the center. A notch 22 is provided respectively at the end of the two side walls of the cover means 2 and a number of openings 23 are provided on both the upper and the lower surfaces. An assembling seat 3 is so configured that it may be inserted into the inner space of the cover means 2 and buttons 34 corresponding to the openings 23 provided on both the upper and the lower sides of the cover means are provided thereon. A plurality of biasing means 31 having upper holes 310 biasing together with the biasing means 31 are provided integrally with the assembling seat 3 which is linked with the biasing means 31 at only one side. A plurality of lower holes 32 corresponding to that of the upper holes 310 are provided at the lower side of the assembling seat 3. The assembling seat 3 further comprises side plate 35 at the lower side. A guiding plate 33 corresponding respectively to the notch 22 of the cover means 2 is provided on the outer side surface and hole 331 is provided both on the two sides and the guiding plate 33. The hole 331 is shaped as a non-closed arc having a diameter smaller than that of the pivotal shaft 11 of the seat 1 and has a trumpet-like outlet end, therefore, the guiding plate 33 is firmly secured when the assembling seat 3 is inserted into the cover means 2. Moreover, with the help of the hole 331, the pivotal shaft 11 of the seat 1 is slidably movably connected thereto. A link 6 is provided with a series of holes 61 thereon. The multiple movable leaves 5 are provided at the center of the upper end with upper protrusions 51 which corresponds to the upper holes 310 of the assembling seat 3, and which may be pivotally connected therein, and at the center of the lower end of the leaves 5, a first lower protrusion 52 which corresponds to the lower holes 32 of the assembling seat 3 is provided for pivotally connecting with the holes 32. At the other side of the lower end of the movable leaves 5, a second lower protrusion 53 which corresponds to the series of holes 61 of the link 6 is provided for pivotally connecting with the holes 61. A hole 410 of the adjusting rod 41 has a width which is enough for receiving the movable leaf 5 moving freely therein and an adjusting hole 54 which is provided within the movable leaf 5 which is closest to the adjusting rod 41 of the pushing button 4 for positioning the end of the adjusting rod 41 at the suitable location within the adjusting hole 54.

Figure 4:
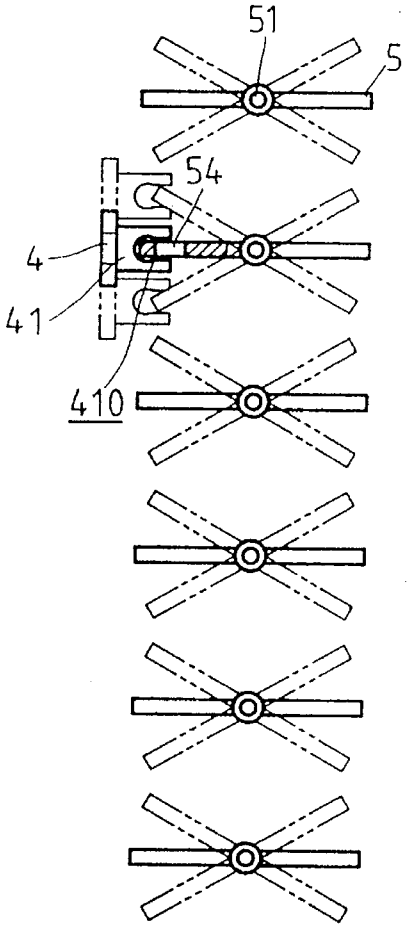
FIG. 4 is a plan view of the invention showing the horizontal controlling of the movable leaves.
Figure 3:
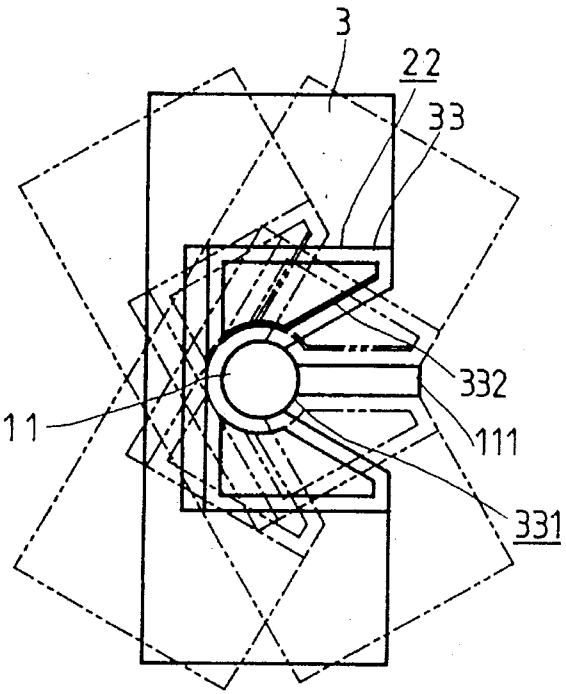
FIG. 3 is a plan view of the invention showing the elevation controlling of the cover means.
Figure 5:
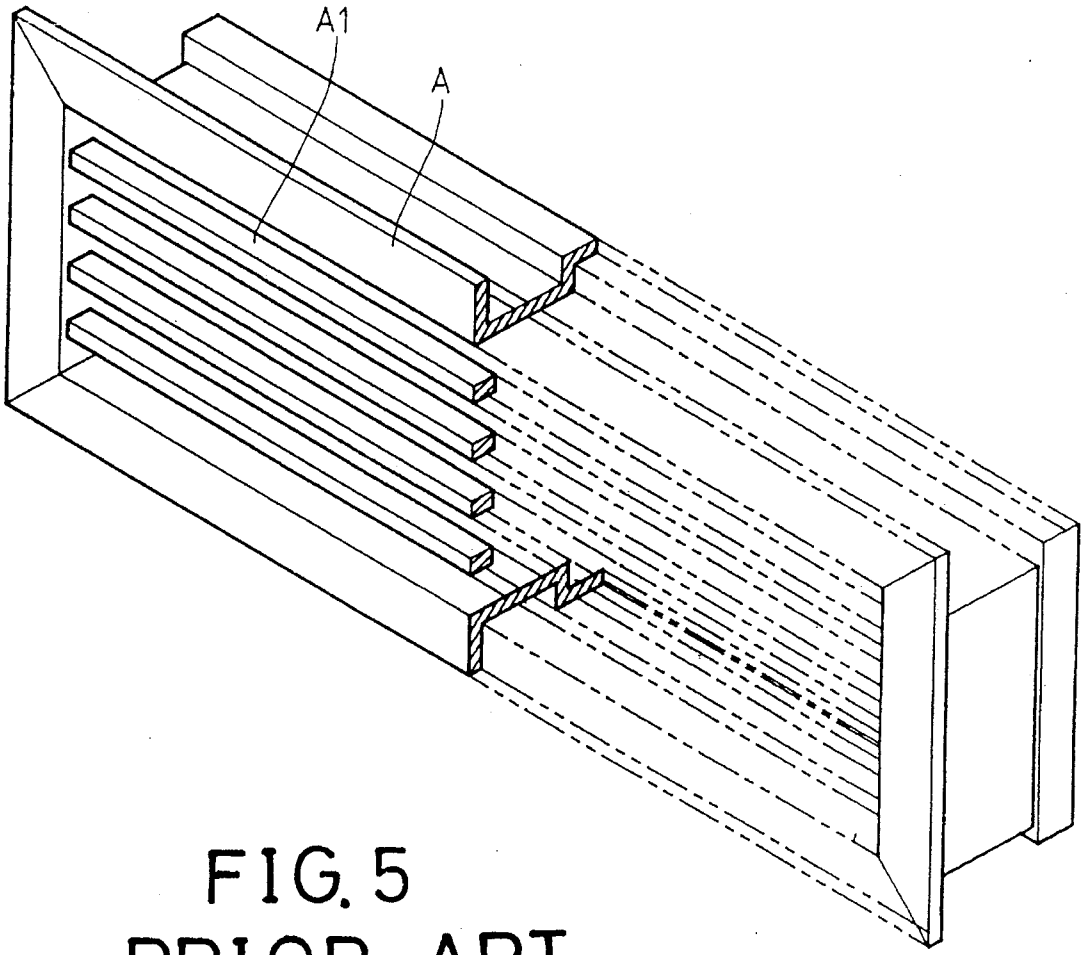
FIG. 5 PRIOR ART
FIG. 5 is a partially sectional view of the structure of a prior air-conditioner outlet.
Figure 6:
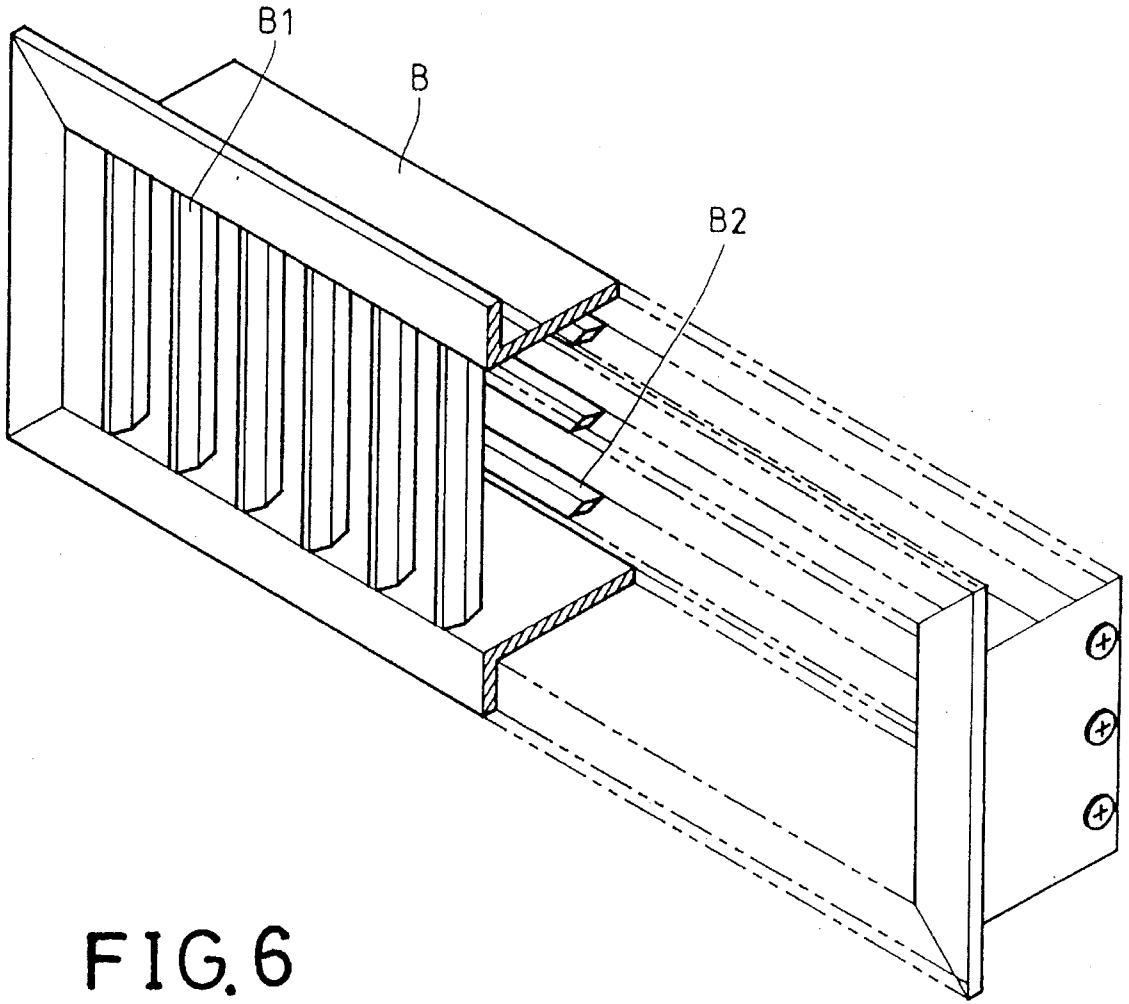
FIG.6 PRIOR ART
FIG. 6 is also a partially sectional view of the structure of another known air-conditioner outlet.

When the present invention is assembled, it is first to secure the seat 1 within the hole predetermined on a wall, then connect the upper protrusion 51 of the movable leaf 5 with the upper hole 310 of the assembling seat 3, and connect the first lower protrusion 52 and the second lower protrusion 53 respectively with the lower hole 32 of the assembling seat 3 and one of the hole 61 of the link 6, by means of the spring of the biasing means 31, the movable leaves 5 are secured biased, consequently, the movable leaves 5 are moved accordingly when one of which is adjusted. After the assembling seat 3 is provided with movable leaves 5, the guiding plate 33 of the assembling seat 3 is directed into and secured within the notch 22 of the cover means 2 and thus the buttons 34 on the upper and the lower sides of the assembling seat 3 are received within the opening 23 of the cover means 2. Thus, the movable leaf 5 having adjusting hole 54 is received within the groove 410 of the adjusting rod 41 of the pushing button 4, and allowing the end of the adjusting rod 41 be in a suitable position on both sides of the adjusting hole 54. Finally, the assembling seat 3 together with the cover means 2 are inserted into the opening 10 of the seat 1 and allowing the hole 331 of the assembling seat 3 to be connected with the pivotal shaft 11 of the seat 1. Due to the dimension of the non-closed arc outlet end of the hole 331 of the assembling seat 3 is smaller than the outer diameter of the pivotal shaft 11, and the provision of a groove 332 on both sides of the non-closed arc and the trumpet-like outlet, it only needs to insert the pivotal shaft 11 into the trumpet-like outlet of the assembling seat 3, and by the resilience of the hole 331, the pivotal shaft 11 is firmly secured within the hole 331. With the structure of the invention, it is able to adjust the horizontal and elevational angle of the wind outlet 20 of the cover means 2 with the help of the linkage of the pivotal shaft 11 with the hole 331, and allowing both sides of the trumpet-like outlet be blocked by the blocking plate 111 of the seat 1 to limit the turning angle, as shown in FIG. 3. Referring to FIG. 4, by moving the movable leaf 5 inserted into the groove 410 of the adjusting rod 41 with the adjusting rod 41 of the pushing button 4, the horizontal wind direction is adjusted. When it is necessary to clean the outlet of the present invention, it only needs to pull the cover means 2 and the assembling seat 3 apart through the hole 331 and pressing the side plate 35 of the assembling seat 3, allowing the buttons 34 on the upper side of the assembling seat 3 to leave the connection with the openings 23 on the upper side of the cover means 2. Therefore, it is very easy to assemble and disassemble the outlet of the invention.

What is claimed is:

1. An air-conditioner outlet comprising:

a base seat (1) having multiple openings (10), on the inside wall of which, pivotal shaft (11) is provided corresponding to one another, and said pivotal shaft (11) extending backward forming a blocking plate (111);

a cover means (2), being so configured and confined with side walls and upper and lower walls that said cover means (2) may be inserted into said openings (10) of said base seat (1), having a plurality of wind outlets (20) with a horizontal slot (21) provided therein, for slidably receiving a pushing button (4) within said slot (21), wherein said pushing button is provided with an adjusting rod (41) on both side walls, a notch (22) is provided thereon, and on both the upper and the lower walls, multiple openings (23) are provided thereon;

an assembling seat (3) having the configuration to be inserted into said cover means (2) and a plurality of exterior buttons (34) corresponding to said openings (23) of said cover means (2) for securely connecting said assembling seat (3) with said cover means (2) through the connection between said exterior buttons (34) and said openings (23), on the upper side of said assembling seat (3), a plurality of upper holes (310) corresponding to a plurality of lower holes (32) provided on the lower side of said assembling seat (3) are provided, on both sides of said assembling seat (3), a hole (331) is provided for receiving said pivotal shaft (11) of said base seat (1), and on the lower side of said assembling seat (3), a side plate (35) is provided;

a link (6) having a series of holes (61) provided thereon;

multiple movable leaves (5) having upper protrusions (51) corresponding to said upper holes (310) of said assembling seat (3) and first lower protrusions (52) corresponding to said lower holes (32) of said assembling seat (3), which respectively are provided at the center of the upper part and the lower part, on the other side of the lower part, second lower protrusions (53) corresponding to said holes (61) of said link (6) are provided for connecting with said holes (61), furthermore, one of said movable leaves (5) closest to said pushing button (4) is provided with an adjusting hole (54) for providing space enough for receiving said adjusting rod (41) when said adjusting rod (41) is moved to adjust said movable leaves (5) through the linkage with said link (6) to have a horizontal angle change result of said movable leaves (5).

2. The outlet as claimed in claim 1, wherein said blocking plate (111) is provided horizontally.

3. The outlet as claimed in claim 1, wherein multiple biasing means (31) having said upper holes (310) are provided on said assembling seat.

4. The outlet as claimed in claim 1, wherein guiding plates (33) are provided correspondingly to said notch (22) of said cover means (2) with both the outer sides of said assembling seat (3), and a hole (331) configured as a non-closed arc having an outlet smaller than the diameter of said pivotal shaft (11) of said base seat (1), said outlet of said arc is formed as a trumpet opening having a groove (332) for receiving said pivotal shaft (11) due to the resilience of said groove (332).

5. The outlet as claimed in claim 1, wherein said adjusting rod (41) having a groove (410) may be inserted into said adjusting hole (54) of said movable leaf (5).

* * * * *